United States Patent [19]

Koniuk

[11] Patent Number: 4,619,059

[45] Date of Patent: Oct. 28, 1986

[54] BOOT ACCESSORY

[76] Inventor: Wayne A. Koniuk, 324 Divisadero St., San Francisco, Calif. 94117

[21] Appl. No.: 637,120

[22] Filed: Aug. 2, 1984

[51] Int. Cl.[4] ..... A43B 5/00; A43B 5/04; A43B 5/18

[52] U.S. Cl. ..... 36/132; 36/7.5; 36/117

[58] Field of Search ..... 36/132, 136, 117, 7.5, 36/7.3

[56] References Cited

U.S. PATENT DOCUMENTS

| | | | |
|---|---|---|---|
| 2,932,910 | 4/1960 | Brown | 36/7.5 X |
| 3,590,410 | 7/1971 | Shields . | |
| 3,965,586 | 6/1976 | Roosli | 36/7.3 |
| 3,971,144 | 7/1976 | Brugger-Stuker . | |
| 4,156,316 | 5/1979 | DeFever | 36/132 |
| 4,160,301 | 7/1979 | Woolley . | |
| 4,199,880 | 4/1980 | Frey . | |
| 4,228,602 | 10/1980 | Groves . | |
| 4,286,397 | 9/1981 | Booty . | |
| 4,294,025 | 10/1981 | Keller . | |
| 4,461,104 | 7/1984 | Calkin et al. | 36/132 |
| 4,505,057 | 3/1985 | Kiester | 36/117 |

FOREIGN PATENT DOCUMENTS

| | | | |
|---|---|---|---|
| 2495902 | 6/1982 | France | 36/117 |
| 580927 | 10/1976 | Switzerland | 36/132 |
| 588832 | 6/1977 | Switzerland | 36/132 |
| 467506 | 6/1937 | United Kingdom | 36/7.5 |

*Primary Examiner*—James Kee Chi

*Attorney, Agent, or Firm*—Flehr, Hohbach, Test, Albritton & Herbert

[57] ABSTRACT

There is disclosed herein an accessory removably attachable to the underside of a boot of the type which, when worn on the foot of an individual users, locks the users ankle within the boot, whereby the boot's underside is locked in a fixed position relative to the users ankle. The boot accessory includes an accessory body having a top side, an underside and an outer periphery and means for removably attaching the accessory body to the boot so that its top side confronts the boots underside, whereby to cause the user to walk on the underside of the accessory body rather than the boot. At the same time, the accessory body is constructed such that its underside will resiliently deform under the weight of a user without causing its top side to do so. In this way, the underside of the accessory body is able to flex relative to its top side and thus conform to irregular or inclined surfaces while its top side remains in a fixed position relative to the underside of the users boot and therefore the users ankle, making it more comfortable for the user to walk on irregular or inclined surfaces and safer to walk on stairs.

10 Claims, 8 Drawing Figures

BOOT ACCESSORY

The present invention relates generally to boots such as ski boots which, when worn on the feet of an individual user, lock the users ankles in place. The present invention relates more particularly to a boot accessory which is removably attachable to the underside of each boot and which is specifically designed to make it more comfortable for the user to walk on irregular and inclined surfaces and to make it safer for the user to walk up and down steps.

The construction of a ski boot is such that, when worn on the foot of a user, it locks the users ankle in place within the boot. More specifically, the ski boot eliminates both upward motion (dorsi-flexion) and downward (plantar flexion) as well as side to side motion (inversion-eversion). The ankle is fixed at an upward angle, as diagrammatically exemplifed in FIG. 1. This, in turn, causes the knee to be thrust forward when standing, as diagrammatically exemplified in FIG. 2, creating the correct knee bend (flexion) necessary for downhill skiing. However, this forward thrust of the knee when standing erect is extremely abnormal, and attempting to walk in this position creates a great deal of discomfort, and requires enormous amounts of energy. In the case of an amputee skier this problem makes it almost impossible to walk with the ski boot on. Hopping on one leg is absolutely necessary for the amputee skier when crutchs are not available. It is impossible to hop on one boot under these circumstances.

A second problem associated with walking on ski boots is that they are designed to allow firm attachment of the boots to the ski bindings and thus to the skis themselves. As a result, the sole of each boot is completely rigid and almost always greater in length than the natural foot. This rigid sole prevents forefoot motion, making it extremely difficult to roll over the toe. The rigid sole and the fixed ankle together eliminate the ability of the foot to move from side to side (inversion-eversion) and adjust to slants and/or irregularities in the walking surface. In addition, it is extremely difficult to walk up or down stairs in ski boots since the users feet cannot flex relative to his knees. As a result, the user typically moves up and down stairs by engaging only the outer corner of each step. Because of the rigidity of the ski boots' soles, it is difficult to feel these edges and therefore it is difficult to move up and down the steps.

In addition to the problems thus far discussed, ski boots provide little if any shock absorption. During normal walking (without ski boots), the foot, ankle and knee all work together in controlled flexing motions to decrease the shock of the users body weight which is constantly thrust on to each leg as each step is taken. When the user wears ski boots, this ability to decrease body weight shock is eliminated due to the rigidity of the boots' soles. Thus not only causes difficulty and discomfort in walking, but also an abnormal stress to the entire body as the shock waves are absorbed by the leg segments and the spinal column. With the amputee skier, this problem is again magnified a great deal because he must throw his entire body weight forward using crutchs, or attempt to hop.

There has been an attempt in the prior art to eliminate or at least reduce some of the foregoing problems by providing an accessory which includes an arcuate (rocker type) sole. One example is illustrated in U.S. Pat. No. 4,160,301 (WOOLLEY). Another example is illustrated in U.S. Pat. No. 4,286,397 (BOOTY). The accessories in both the Woolley and Booty patents aid in correcting some of the above described problems by adding rocker type of soles to ski boots. However, neither type of accessory nor any others that applicant is aware of reliably compensate for irregular or inclined surfaces and none make it substantially easier and/or safer for the user to walk up or down stairs.

In view of the foregoing, it is an object of the present invention to provide boot accessories which substantially reduce and/or entirely eliminate all of the foregoing problems including specifically the problems associated with walking on inclined and irregular surfaces while wearing ski boots and as well as reducing or eliminating those problems associated with walking up and down stairs while wearing ski boots. This object is achieved by providing a boot accessory designed in accordance with the present invention. This accessory includes an accessory body having a top side and an underside and means for removably attaching the accessory body to its cooperating ski boot so that the top side of the accessory body confronts the boots underside, whereby to cause the user to walk on the underside of the accessory body rather than the boot. In accordance with the present invention, the accessory body is constructed such that its underside will resiliently deform under the weight of the user without causing its top side to do so. In this way, the underside of the accessory body will flex relative to its top side and thus conform to irregular or inclined surfaces including the edges of steps. At the same time, its top side remains in a fixed position relative to the underside of the users boots and therefore the users ankle, making it easier, more comfortable and/or safer for the user to walk on inclined and irregular surfaces as well as on stairs. In a preferred and actual working embodiment of the present invention, this is accomplished by designing the accessory body to include a resiliently deformable outer skin across its entire top side, bottom side and outer periphery and a less dense, more resilient deformable interior section.

The over-all boot accessory including its accessory body will be described in more detail hereinafter in conjunction with the drawings wherein:

FIGS. 1 and 2 diagrammatically exemplify how a typical ski boot locks a users ankle in place (FIG. 1) and how it causes a users knee to move relative to his ankle when the skier is in a normal ski stance (FIG. 2);

Figure 1:
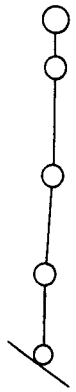
Figure 2:
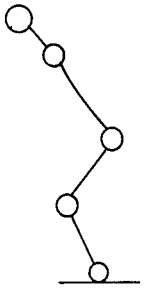
Figure 3:
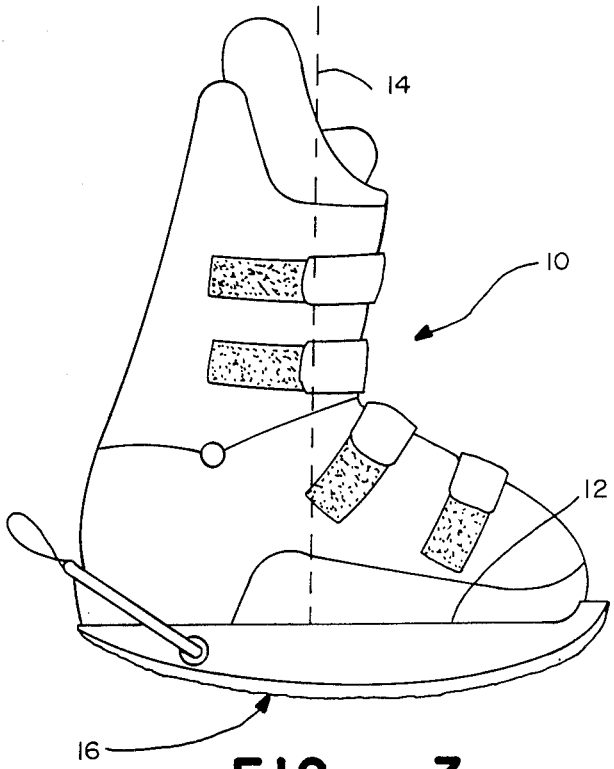
FIG. 3 is a side elevational view of a typical ski boot including a boot accessory designed in accordance with the present invention.
Figure 4:
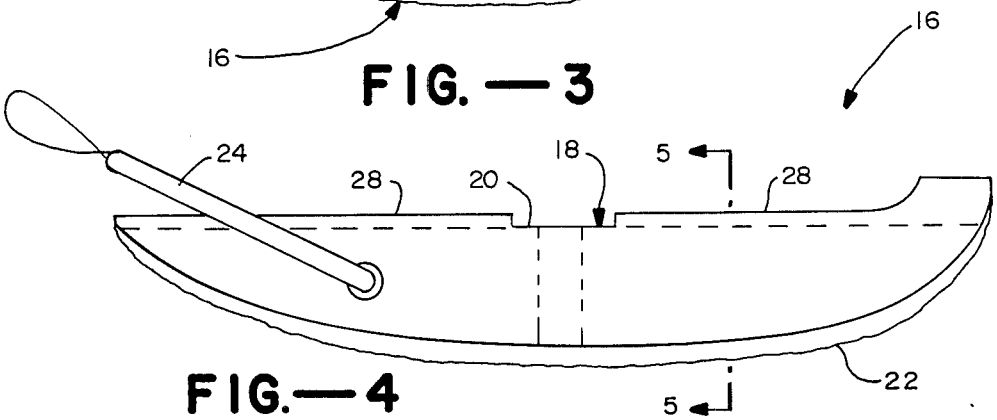
FIG. 4 is an enlarged side elevational view of the boot accessory of FIG. 3 apart from the ski boot.

Turning now to the drawings, wherein like components are designated by like reference numerals throughout the various Figures, attention is directed first to FIGS. 3 and 4 since FIGS. 1 and 2 have been discussed previously. FIG. 3 illustrates a boot 10, typically a ski boot, of the type which when worn on the foot on an individual user locks the users ankle in place within the boot, specifically in the manner discussed above with respect to FIGS. 1 and 2. As a result, the boot's underside 12 is locked in a fixed position relative to the users ankle, as indicated by dotted lines 14. FIG. 3 also illustrates a boot accessory 16 removably attached to the underside of the boot. As will be discussed in more detail hereinafter, this accessory is designed in accordance with the present invention to overcome the previously recited problems with wearing ski boots.

Referring to FIG. 4 in conjunction with FIG. 3, boot accessory 16 is shown including an accessory body 18 having a flat top side 20, an underside 22 and an outer periphery which corresponds generally to the underside 12 of boot 10. The underside 22 is outwardly arcuate longitudinally a slight amount to provide the "rocking action" of the prior art when worn by the user. Accessory 16 also includes means for removably attaching the accessory body to the boot so that top side 20 confronts the boots underside 12, whereby to cause the user to walk on the underside 22 of the accessory body rather than the underside of the boot. To this end, this attaching means includes suitable strap means 24, a front locking cap 26 and longitudinally extending flanges 28 projecting up from the top side 20 of accessory body 18 on opposite longitudinal sides of the latter. These latter flanges and the locking toe 26 may be provided as an integral part of the over-all accessory body, as shown. Also, it is to understood that neither flanges nor the locking toe or the strap means 24 form part of the present invention other than as suitable means for removably attaching the accessory body to boot 10 in the manner just recited. However, the accessory body itself is designed in accordance with the present invention to make it more comfortable for the user to walk with ski boots on, especially on inclined and irregular surfaces, while, at the same time, making it safer for the user to walk up and down stairs with ski boots on, as will be discussed hereinafter.

Figure 5:
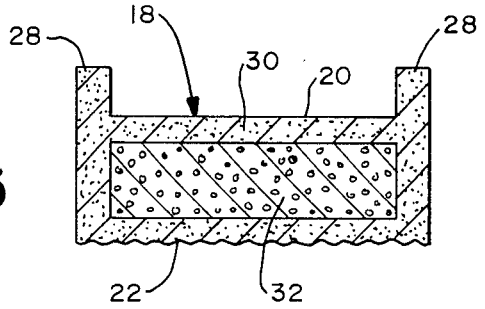
FIG. 5 is a sectional view of the boot accessory of FIG. 4 taken generally along lines 5—5 in FIG. 4.

Referring to FIG. 5, accessory body 18 is shown in sectional view. This accessory body includes a resiliently deformable outer skin 30 extending across its entire top side, bottom side and outer periphery and a less dense, more resilient deformable interior section 32. In an actual working embodiment, both the more dense outer skin 30 and the lesser dense interior section 32 are constructed of flexible foam having respective densities of about 20 lb./ft$^3$ and 6 lb./ft$^3$. In this same actual working embodiment, the outer skin is $\frac{1}{4}''$ inch thick while interior section 32 is $1'' \times 2\ 7/8$ inches thick.

Figure 6:
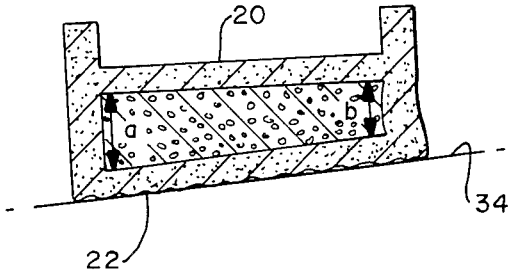
FIGS. 6, 7 and 8 diagrammatically illustrate how the boot accessory of the present invention resiliently deforms under the weight of the user as the user walks on an inclined surface (FIG. 6), upstairs (FIG. 7), and an irregular surface (FIG. 8).
Figure 8:
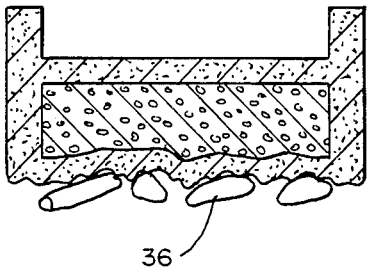

Accessory body 18 is constructed in the manner just described so that its slightly arcuate underside 22 will deform under the weight of the user without causing its top side 20 to do so. In this way, the underside of the accessory body will flex relative to its top side and thus conform to inclined or irregular surfaces while its top side remains in a fixed position relative to the underside of the users boot and therefore the users ankle. This is best exemplified in FIGS. 6 and 8. In FIG. 6, note that the user is on a transverse incline surface 34 relative to the longitudinal axis of the accessory body. Under the weight of the user, the accessory body deforms so that its underside 22 conforms with incline surface 34 while top side 20 remains horizontal. In other words, the dimension A in FIG. 6 increases while the dimension B decreases. In FIG. 8, the underside 22 of the accessory body is shown deforming inwardly as a result of an irregular or uneven surface generally indicated at 36 while top side 20 again remains horizontal. In both of these cases (FIG. 6 and FIG. 8), the deformations noted insulate the user from inclined, irregular or uneven surfaces since, in all of these cases, top side 20 remains horizontal, that is, in a fixed position relative to the boot itself and therefore the users ankle. It is to be understood that this is true to a limited extent only. If the incline 34 in FIG. 6 becomes to extreme, accessory body will no longer compensate for the entire incline and if the irregularities or uneven surfaces 36 in FIG. 8 become to great, the accessory body will no longer compensate for all of these irregularities or uneven surfaces. Rather, the top side 20 will begin to incline or otherwise shift or no further deformation will take place.

Figure 7:
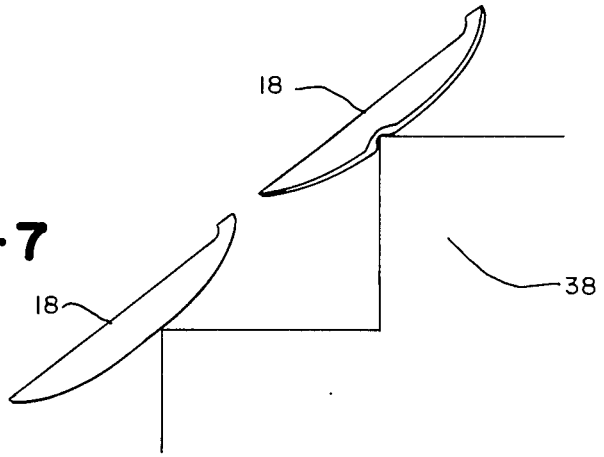

In addition to compensating for inclined surfaces, irregularities or uneven surfaces making it more comfortable for the user to walk on such surfaces, accessory body 18 also makes it safer for the user to walk up and down stairs. This is best illustrated in FIG. 7 where two such accessory bodies are shown engaging the outer edges of the stairway generally indicated at 38. Because the users ankles are fixed in place within the boots, it is difficult if not impossible for the user to walk up or down stairs by engaging the horizontal surfaces of the various steps. Rather, as indicated previously, the user tends to walk on the edges, as illustrated in FIG. 7. By providing each accessory body with the resiliently deformable construction described above, the underside 22 of each body deforms inwardly under the weight of the user as the body engages the steps outer edge. These inward deformations serve as means of gripping the steps as the user moves up and down them and, at the same time, they cause the user to better "feel" each edge.

While accessory body has been described having resiliently deformable outer skin and a less dense, more resiliently deformable interior section, it is to be understood that the accessory body can be made in other ways so long as its underside will resiliently deform under the weight of the user without causing its top side to do so whereby to provide the advantages discussed with regard to FIGS. 6–8. Moreover, while the overall accessory has been described in combination with ski boots, it is equally useful in combination with other types of boots which displays the same constraints as ski boots.

What is claimed is:

1. A boot accessory removably attached to the underside of a downhill ski boot which, when worn on the foot of an individual user, locks the user's ankle in place within the boot, said accessory comprising: an accessory body having a topside, an underside and an outer periphery which corresponds generally to the underside of said boot and thereby includes a lengthwise axis and a shorter widthwise axis; and means for removably attaching said accessory body to said boot so that it topside confronts the boot's underside, whereby to cause the user to walk on the underside of the accessory body rather than the boot; said accessory body being constructed so as to be resiliently deformable under the weight of the user at substantially all points along its lengthwise and widthwise axes and sufficiently thick so that the resilient deformation causes the underside of the accessory body to deform and does not cause its topside to deform in order to cause the underside of the accessory body to flex relative to its topside and thus conform to irregular or inclined surfaces without causing the topside to do so.

2. A boot accessory according to claim 1 wherein said accessory body includes a resiliently deformable outerskin and a more resiliently deformable interior section.

3. A boot accessory according to claim 2 wherein the underside of said accessory body is outwardly arcuate in shape along the lengthwise axis of the body.

4. A boot accessory removably attachable to the underside of a downhill ski boot which, when worn on the foot of an individual user, locks the user's ankle in place within the boot whereby the boot's underside is locked in a fixed position relative to the user's ankle, said accessory comprising: an accessory body having a topside, an underside and an outer periphery which corresponds generally to the underside of said boot; and means for removably attaching said accessory body to said boot so that its topside confronts the boot's underside, whereby to cause the user to walk on the underside of the accessory body rather than the boot; said accessory body being constructed such that its underside will resiliently deform under the weight of the user without causing its topside to do so in order to cause the underside of the accessory body to flex relative to its topside and thus conform to irregular or inclined surface while its topside remains in a fixed position relative to the underside of the user's boot and therefore the user's ankle.

5. A boot accessory according to claim 4 wherein said accessory body is sufficiently resilient to provide resilient deformation under the weight of the user and sufficiently thick to allow its underside to resiliently deform under the weight of the user without causing its topside to do so.

6. A boot accessory according to claim 4 wherein said accessory body includes a resiliently deformable outerskin and a more resiliently deformable interior section.

7. A boot accesory according to claim 4 wherein the underside of said accessory body is outwardly arcuate in shape along a lengthwise axis of the body.

8. A boot accessory according to claim 4 wherein said outer skin and said interior section are constructed of flexible foam.

9. A boot accessory according to claim 8 wherein said outerskin has a density of about 20 $lb/ft^3$ and said interior section has a density of about 6$lb./ft^3$.

10. A ski boot assembly, comprising a downhill ski boot which, when worn on the foot of an individual user, locks the user's ankle in place within the boot whereby the boot's underside is locked in a fixed position relative to the user's ankle; and a boot accessory removably attached to the underside of said boot, said accessory including: an accessory body having a topside, an underside and an outer periphery which corresponds generally to the underside of said boot, and means for removably attaching said accessory body to said boot so that its topside confronts the boot's underside, whereby to cause the user to walk on the underside of the accessory boot rather than the boot, said accessory body being constructed such that its underside will resiliently deform under the weight of the user without causing its topside to do so in order to cause the underside of the accessory body to flex relative to its topside and thus conform to irregular or inclined surface while its topside remains in a fixed position relative to the underside of the user's boot and therefore the user's ankle.

* * * * *